US011577240B2

(12) United States Patent
Zhou et al.

(10) Patent No.: US 11,577,240 B2
(45) Date of Patent: Feb. 14, 2023

(54) LIQUID STORAGE AND CONTROLLED-RELEASE DEVICE AND BIOLOGICAL DETECTION CHIP

(71) Applicants: Capitalbio Corporation, Beijing (CN); West China Hospital of Sichuan University, Sichuan (CN)

(72) Inventors: Xinying Zhou, Beijing (CN); Lei Wang, Beijing (CN); Liang Bai, Beijing (CN); Tengfei Guo, Beijing (CN); Shuo Li, Beijing (CN); Baolian Li, Beijing (CN); Bin Zhuang, Beijing (CN); Xiang Chen, Beijing (CN); Hongju Guo, Beijing (CN); Xiaolei Zhao, Beijing (CN); Wanli Xing, Beijing (CN); Jing Cheng, Beijing (CN)

(73) Assignees: Capitalbio Corporation, Beijing (CN); West China Hospital of Sichuan University, Chengdu (CN)

( * ) Notice: Subject to any disclaimer, the term of this patent is extended or adjusted under 35 U.S.C. 154(b) by 128 days.

(21) Appl. No.: 17/166,546

(22) Filed: Feb. 3, 2021

(65) Prior Publication Data

US 2021/0322979 A1 Oct. 21, 2021

(30) Foreign Application Priority Data

Apr. 18, 2020 (CN) ..... 202010308399.5

(51) Int. Cl.
*B01L 3/00* (2006.01)

(52) U.S. Cl.
CPC ..... *B01L 3/502715* (2013.01); *B01L 3/523* (2013.01); *B01L 2300/0816* (2013.01);
(Continued)

(58) Field of Classification Search
CPC ..... B01L 3/502715; B01L 3/523; B01L 2300/0816; B01L 2300/0887;
(Continued)

(56) References Cited

U.S. PATENT DOCUMENTS

2014/0087479 A1 3/2014 Albuquerque et al.
2015/0314924 A1 11/2015 Hortig et al.
(Continued)

FOREIGN PATENT DOCUMENTS

CN 104399540 A 3/2015
CN 104884169 A 9/2015
(Continued)

OTHER PUBLICATIONS

Extended European Search Report in European Patent Application No. 21153626.3, dated Jul. 19, 2021.

*Primary Examiner* — Jennifer Wecker
*Assistant Examiner* — Oyeleye Alexander Alabi
(74) *Attorney, Agent, or Firm* — Knobbe, Martens, Olson & Bear, LLP

(57) ABSTRACT

A liquid storage and controlled-release device and a biological detection chip. The liquid storage and controlled-release device comprises a liquid storage capsule with a liquid storage body which is deformable under a pressure, and a sealing layer for sealing the liquid storage body. A support platform is provided right below the liquid storage capsule and tightly connected with the liquid storage capsule, wherein, a directional release chamber is provided at the middle of the support platform, and the directional release chamber is provided with a guiding chamber for collecting the liquid and a sharp edge for inducing break. Compared with the conventional technology, the opening for liquid release is at the end far away from the rotation center, so that the liquid can be released completely by the cen-
(Continued)

trifugal force, ensuring the quantitative release of stored liquid and reducing the influence on the accuracy of the subsequent detection.

19 Claims, 5 Drawing Sheets

(52) U.S. Cl.
CPC . *B01L 2300/0887* (2013.01); *B01L 2300/123* (2013.01); *B01L 2400/0481* (2013.01)

(58) Field of Classification Search
CPC ..... B01L 2300/123; B01L 2400/0481; B01L 2300/044; B01L 2300/0672; B01L 2300/0803; B01L 2400/0409; B01L 2400/0683; B01L 3/502738; B01L 3/527; B01L 3/502707; B01L 3/5027
See application file for complete search history.

(56) References Cited

U.S. PATENT DOCUMENTS

2017/0095812 A1 4/2017 Boehm et al.
2017/0282179 A1* 10/2017 Albuquerque ..... G01N 1/28

FOREIGN PATENT DOCUMENTS

| | | | |
|---|---|---|---|
| CN | 207520980 | U | 6/2018 |
| CN | 108472648 | A | 8/2018 |
| CN | 110252434 | A | 9/2019 |
| CN | 110302850 | A | 10/2019 |
| CN | 110508338 | A | 11/2019 |
| EP | 3023335 | A1 | 5/2016 |
| EP | 3151963 | A1 | 4/2017 |
| WO | WO 2015/150742 | A1 | 10/2015 |
| WO | WO 2015/181170 | A1 | 12/2015 |

* cited by examiner

LIQUID STORAGE AND CONTROLLED-RELEASE DEVICE AND BIOLOGICAL DETECTION CHIP

CROSS REFERENCE TO RELATED APPLICATIONS

This application claims the priority of Chinese Patent Application No. 202010308399.5, filed on Apr. 18, 2020, and the disclosures of which are hereby incorporated by reference.

FIELD

The present disclosure relates to the technical field of biological detection equipment, and in particular to a liquid storage and controlled-release device and a biological detection chip.

BACKGROUND

With the development of In Vitro Diagnosis (IVD) technology, more and more biochemical, immunological, and molecular diagnostic products have emerged. Among them, products based on microfluidic chip technology are developing in the direction of miniaturization, function integration, and ease of operation. Based on the above requirements, the storage of reagents in microfluidic chips has become a technical problem that needs to be overcome. At present, the reagent storage method in the chip can be roughly divided into a solid storage and a liquid storage. Among them, the solid storage has the following limitations: 1) the range of applicable reagents is limited, and not all reagents can be stored in a solid state; 2) low production efficiency and high cost; 3) the reagents stored in the solid state need to be re-dissolved and thoroughly mixed before they can be used to realize their functions, and the mixing operation is not easy to be achieved under the tiny scale of the microfluidic chip, which in turn will lead to new problems; 4) the reagent in the dry state requires higher storage conditions for the whole chip, and once it gets wet during storage, the entire chip will fail even within the validity period.

The current liquid storage method cannot guarantee that the liquid is completely released. Due to the presence of liquid residue, the quantitative release of liquid cannot be achieved, especially in the microfluidic chip driven by centrifugal force that requires multi-step liquid release. In the subsequent centrifugation step, the remaining reagent in the liquid storage unit has an uncontrollable outflow risk, which affects the accuracy of subsequent detection. For example, the Chinese Patent Publication No. CN104884169A discloses a film bag for storing fluid and a device for providing fluid. In this publication, a film bag with a predetermined breaking point is placed in a sealed chamber, and the film bag contains a certain volume of liquid. Pressure is applied to the film bag through the pressure plate on the top of the sealed chamber, so that the liquid in the bag is subjected to pressure to expand and rupture from the predetermined breaking point; as the pressure plate continues to be pressed down, the liquid in the bag is released. In this publication, since the liquid is stored in the film bag, the liquid cannot be completely released. Even if the pressure plate is pressed down to the limit, there will still be residual liquid in the film bag, so accurate and quantitative release of the liquid cannot be achieved. In addition, in the technical solution of CN104884169A, the liquid release opening, that is, the predetermined breaking point, is also at the sealing surface. When the pressure plate is pressed to compress the volume and cause the liquid to release, it will inevitably cause an increase in air pressure in the overall system. Therefore, this method is not suitable for biological detection chips that require an enclosed condition, especially heating reaction conditions, such as nucleic acid lysis, nucleic acid amplification and other biological detection chips.

Therefore, the technical problem that needs to be solved by a person skilled in the art is to realize the directional and quantitative release of the stored liquid without any liquid residue that affects the subsequent experimental procedure.

SUMMARY

An object of the present disclosure is to provide a liquid storage and controlled-release device and a biological detection chip, so as to realize the directional and quantitative release of the stored liquid without any liquid residue, reducing the influence on the accuracy of subsequent detection due to the failure of quantitative release.

In order to achieve the object, a liquid storage and controlled-release device is provided in the present disclosure, which is arranged on a substrate, and the substrate is driven to rotate by a centrifugal force. The liquid storage and controlled-release device comprises:

a liquid storage capsule, wherein, the liquid storage capsule is provided with a liquid storage body which is deformable under a pressure and a sealing layer for sealing the liquid storage body, and a space formed by the sealing layer and the liquid storage body is configured for liquid storage, a sealing region is provided between the sealing layer and the liquid storage body, and seal strength of the sealing region is greater than strength required to break the sealing layer under a force;

a support platform is provided right below the liquid storage capsule and tightly connected with the liquid storage capsule, wherein, a directional release chamber is provided in the middle of the support platform, and the directional release chamber is provided with a guiding chamber for collecting the liquid and a sharp edge for inducing break, the edge is formed by a side wall at distal end (far away from the rotation center) of the guiding chamber on the top, and the depth of the guiding chamber is greater than the maximum downward deformation depth of the sealing layer before broken when the liquid storage body is subjected to a pressure; and when an external force is applied to the liquid storage body, the sealing layer is forced to deform towards the inside of the guiding chamber, and a breaking point (that is, an opening) on the sealing layer is generated by the edge according to the shape of the edge, so that the liquid storage capsule is in communication with the guiding chamber.

In an embodiment of the present disclosure, the edge for inducing break includes a first edge surface extending from the end face of the support platform to the center of the guiding chamber and a second edge surface extending from the first edge surface to the bottom of the guiding chamber, the junction between the first edge surface and the second edge surface is configured to break the sealing layer, and the breaking point matches the second edge surface, wherein the second edge surface is an arc structure protruding towards the outside of the guiding chamber, or a semicircular structure or a triangular structure protruding towards the inside of the guiding chamber.

In an embodiment of the present disclosure, the liquid storage body is a hemispherical or semi ellipsoidal thermoforming plastic film or cold stamping forming pharmaceutical packaging composite film.

In an embodiment of the present disclosure, the thermoforming plastic film is a thermoforming PVC film, a thermoforming PP film, a thermoforming PE film or a thermoforming PET film, and the cold stamping forming pharmaceutical packaging composite film is an OPA/AL/PVC composite film and an OPA/AL/PP composite film.

In an embodiment of the present disclosure, the thermoforming plastic film or the cold stamping forming pharmaceutical packaging composite film has a thickness between 50 μm and 150 μm.

In an embodiment of the present disclosure, a first aluminum foil layer is provided inside the cold stamping forming pharmaceutical packaging composite film.

In an embodiment of the present disclosure, the sealing layer is sealed on the liquid storage capsule by ultrasonic welding, hot pressing or gluing.

In an embodiment of the present disclosure, the sealing layer has a shape matching with the projection of the liquid storage body on the sealing layer.

In an embodiment of the present disclosure, the sealing layer includes a second aluminum foil layer.

In an embodiment of the present disclosure, the second aluminum foil layer has a thickness between 10 μm and 100 μm.

In an embodiment of the present disclosure, the sealing layer includes a hot-melt adhesive layer coated on the second aluminum foil layer.

In an embodiment of the present disclosure, the volume of the liquid stored in the liquid storage capsule is 40% to 100% of the discharge volume when the liquid storage body is completely concave.

In an embodiment of the present disclosure, the volume of the liquid stored in the liquid storage capsule is 60% to 90% of the discharge volume when the liquid storage body is completely concave.

In an embodiment of the present disclosure, the guiding chamber is a guiding groove recessing downward provided in the substrate, a portion surrounding the guiding groove is the support platform, the guiding groove is in communication with a downstream micro channel, and the whole support platform is tightly covered by the sealing layer.

In an embodiment of the present disclosure, the volume of the guiding groove is greater than, less than or equal to the volume of the liquid storage capsule.

In an embodiment of the present disclosure, the edge extends from the wall of the guiding groove towards the cavity of the guiding groove, and the distal end of the edge corresponds to a region enclosed by the sealing region of the sealing layer.

In an embodiment of the present disclosure, the distance between the highest point of the edge and the sealing layer is not greater than the distance between the upper surface of the substrate and the sealing layer.

In an embodiment of the present disclosure, the groove wall corresponding to a proximal end of the guiding groove is a rounded angle structure protruding to the center of the guiding groove.

In an embodiment of the present disclosure, the liquid storage capsule is tightly connected with the support platform by a connecting layer, welding or a clamping device.

In an embodiment of the present disclosure, when the liquid storage capsule is connected with the support platform through the connecting layer, a side of the connecting layer is fixedly bonded with the support platform, and the another side of the connecting layer is fixedly bonded with the sealing layer.

In an embodiment of the present disclosure, the connecting layer is a double-faced adhesive tape, an ultraviolet curing adhesive or an epoxy adhesive.

In an embodiment of the present disclosure, the shape of the connecting layer is the same as that of the sealing layer.

In an embodiment of the present disclosure, a blank region without material is provided at a position of the connecting layer corresponding to the guiding groove.

In an embodiment of the present disclosure, the blank region without material is circular, semicircular or elliptic.

In an embodiment of the present disclosure, when the connecting layer and the sealing layer completely coincide, the radial outermost end of the blank region without material in the connecting layer is tangent or partially overlapped with the sealing region of the sealing layer.

In an embodiment of the present disclosure, the liquid storage body cooperates with a flat head press to realize the release.

In an embodiment of the present disclosure, the flat head press is driven by manual or instrument.

In an embodiment of the present disclosure, the area of the flat head press is greater than or equal to the top projection area of the liquid storage body.

A biological detection chip is further disclosed of the present disclosure, which includes a substrate and a liquid storage and controlled-release device as described in any one of the above arranged on the substrate.

In an embodiment of the present disclosure, one or more liquid storage and controlled-release devices may be arranged on the substrate, and are respectively communicated with the downstream micro channels.

In an embodiment of the present disclosure, when the substrate is provided with multiple liquid storage and controlled-release devices, the liquid storage and controlled-release devices are arranged on a straight line, or the liquid storage and controlled-release devices are arranged on a circle, or are arranged according to demand.

The present disclosure has the following beneficial effects.

In the liquid storage and controlled-release device of the present disclosure, the liquid is quantitatively sealed in the liquid storage capsule. When external force is applied to press the liquid storage body, the liquid in the liquid storage capsule is forced to expand, so that the sealing layer is gradually pushed to the sharp edge for inducing break. After the edge contacts with the sealing layer, a breaking point (an opening) is generated on the sealing layer according to the shape of the edge, and the liquid storage capsule is in communication with the guiding chamber. The liquid sealed in the liquid storage capsule will flow out of the opening located on the distal end (far away from the rotation center). All the liquid in the liquid storage capsule, driven by the centrifugal force, can be transferred through the opening without a dead angle, so as to realize the complete release of the liquid. It can be seen that, in the above process, the liquid is stored in a space enclosed by the liquid storage body and the sealing layer, this packing method has low requirements for the sealing technique, and this manner of liquid storage can be easily generalized. In the present disclosure, the release of liquid is through a breaking point on the sealing layer at a predetermined position. Compared with the conventional technology, the opening for liquid release is not in the sealing region, which has low requirements for the packing technique. In addition, the opening for liquid release is located at the distal end (far away from the rotation center) of the sealing layer, so that the liquid can be released completely by the centrifugal force, ensuring the quantitative release of stored liquid and reducing the influence on the accuracy of the subsequent detection due to the failure of the quantitative release.

BRIEF DESCRIPTION OF THE DRAWINGS

To illustrate technical solutions according to the embodiments of the present disclosure or in the conventional technology more clearly, the drawings to be used in the description of the conventional technology or the embodiments are described briefly hereinafter. Apparently, the drawings described hereinafter are only some embodiments of the present disclosure, and other drawings may be obtained by those skilled in the art based on those drawings without any creative effort.

REFERENCE NUMERALS

Figure 1:
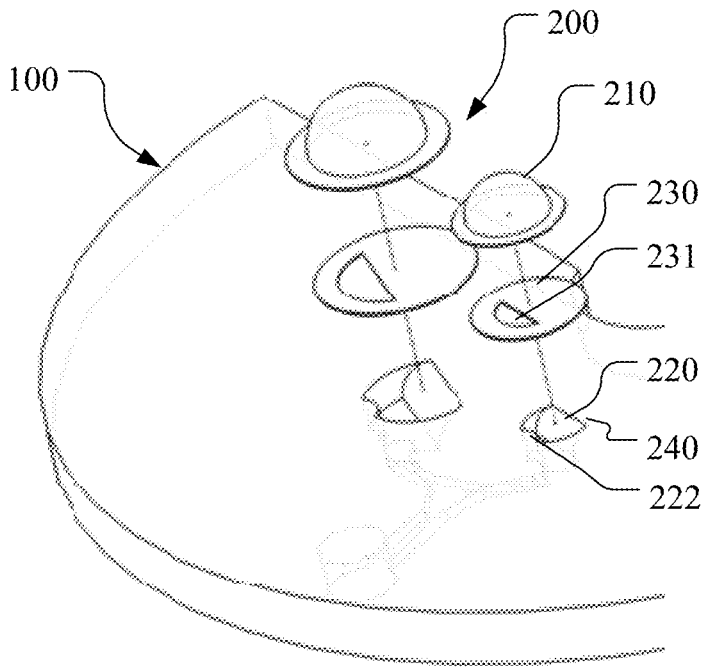
FIG. 1 is an exploded view of a liquid storage and controlled-release device of the present disclosure.
Figure 2:
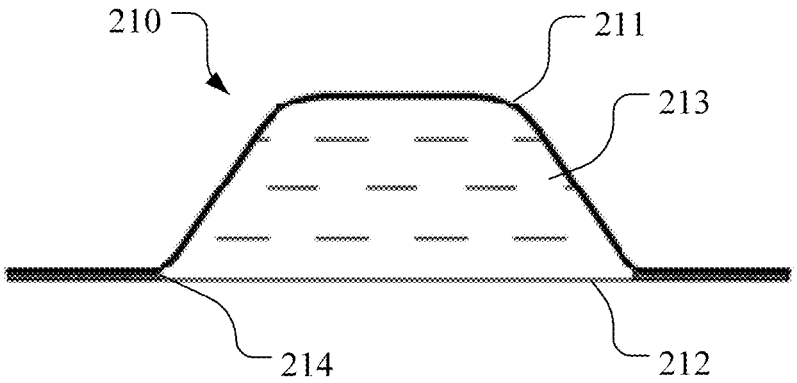
FIG. 2 is a sectional view of a liquid storage capsule of the present disclosure.

| | |
|---|---|
| 100 Substrate, | 101 Micro Channel, |
| 200 Liquid Storage and Controlled-release Device, | 210 Liquid Storage Capsule, |
| 211 Liquid Storage Body, | 212 Sealing Layer, |
| 213 Liquid, | 214 Sealing Region, |
| 220 Directional Release Chamber, | 221 Guiding Chamber, |
| 222 Edge for Inducing Break, | 2221 First Edge Surface, |
| 2222 Second Edge Surface, | 230 Connecting Layer, |
| 231 Blank Region Without Material, | 240 Support Platform. |

DETAILED DESCRIPTION

The present disclosure provides a liquid storage and controlled-release device and a biological detection chip, so as to directionally and quantitatively release liquid from the storage, thereby reducing the influence on the accuracy of the subsequent detection due to the failure of the quantitative release.

In order to make the person skilled in the art have a better understanding of solutions of the present disclosure, the present disclosure is described in further detail hereinafter, in conjunction with the drawings and embodiments.

Referring to FIGS. 1 to 9, the liquid storage and controlled-release device 200 of the present disclosure can be arranged on a substrate 100 and the substrate 100 can be driven by a centrifugal force. The liquid storage and controlled-release device 200 comprises a liquid storage capsule 210 and a support platform 240 located right below the liquid storage capsule 210 and tightly connected to the liquid storage capsule 210, and a directional release chamber 220 is provided at the middle of the support platform 240.

The liquid storage capsule 210 is provided with a liquid storage body 211 which is deformable under a pressure and a sealing layer 212 for sealing the liquid storage body 211, and a space formed by the sealing layer 212 and the liquid storage body 211 is configured for liquid storage, a sealing region 214 is provided between the sealing layer 212 and the liquid storage body 211, and seal strength of the sealing region 214 is greater than strength required to break the sealing layer 212 under a force The directional release chamber 220 is provided with a guiding chamber 221 for collecting the liquid and a sharp edge 222 for inducing break, the edge 222 is formed by a side wall at distal end of the guiding chamber 221 on the top, and the depth of the guiding chamber 221 is greater than the maximum downward deformation depth of the sealing layer 212 before broken when the liquid storage body 211 is subjected to a pressure.

When an external force is applied to the liquid storage body 211, the sealing layer 212 is forced to deform towards the inside of the guiding chamber 221, and a breaking point on the sealing layer 212 is generated by the edge 222 according to the shape of the edge 222, so that the liquid storage capsule 210 is in communication with the guiding chamber 221.

In the liquid storage and controlled-release device 200 of the present disclosure, the liquid is quantitatively sealed in the liquid storage capsule 210. When external force is applied to press the liquid storage body 211, the liquid 213 in the liquid storage capsule 210 is forced to expand the sealing layer 212, so that the sealing layer 212 is gradually pushed to the sharp edge 222 for inducing break. After the edge 222 contacts with the sealing layer 212, a breaking point (an opening) is generated on the sealing layer 212 according to the shape of the edge 222, and the liquid storage capsule 210 is in communication with the guiding chamber 221. The liquid sealed in the liquid storage capsule 210 will flow out of the opening located on the distal end (far away from the rotation center). All the liquid in the liquid storage capsule 210, driven by the centrifugal force, can be transferred through the opening without a dead angle, so as to realize the complete release of the liquid.

It can be seen that, in the above process, the liquid 213 is stored in a space enclosed by the liquid storage body 211 and the sealing layer 212. The release of liquid 213 is through a breaking point on the sealing layer 212 at a predetermined position. Compared with the conventional technology, the opening for liquid release is not in the sealing region 214, which has low requirements for the packing technique. In addition, the opening for liquid release is located at the distal end of the sealing layer 212, so that the liquid 213 can be released completely by the centrifugal force, ensuring the quantitative release of stored liquid and reducing the influence on the accuracy of the subsequent detection due to the failure of the quantitative release.

The liquid storage and controlled-release device 200 has a simple release mode. The liquid 213 is released accurately at a specific position by pressing the liquid storage capsule 210, and the liquid 213 is completely released to the downstream by the centrifugal force with no residue. This design realizes the quantitative release of liquid, improving the stability and reliability of the chip, especially for the process requiring successively release of different liquid reagents.

The liquid is directly sealed in the liquid storage capsule 210 and the sealing layer 212 of the liquid storage capsule 210 is closed, so the liquid storage and controlled-release device 200 has good sealing effect and little volatilization, thereby realizing long-term storage of the liquid.

The technical requirement for the sealing is low, and the storage of the liquid 213 can be generalized. Compared with the conventional technology, the generalization of the mode that the liquid storage and controlled-release device 200 stores the liquid 213 and releases the liquid 213 is good. In addition, on the basis of generalization, the consistency of the production process of the liquid storage and controlled release device 200 is good, which is convenient for large-scale production.

The liquid storage and controlled-release device 200 is light weight, compact and easy to be integrated, which gives a light weight load and small volume burden to the production of biological detection chip. Therefore, the liquid storage and controlled-release device 200 may be widely applied to the biological detection chip.

In the liquid storage and controlled-release device 200, the sealing layer 212 is pushed close to the edge 222 to be broken directionally by directly pressing the liquid storage capsule 210 downward, so the directional release can be completed by moving in the vertical direction only. Therefore, the requirement of control accuracy of the instrument for applying the external force to the liquid storage and controlled-release device 200 is low.

It should be noted that, in the embodiment of the present disclosure, the liquid storage body 211 is deformable under a force, which can be understood as reversible deformation or slightly non-reversible deformation, that is, after the external force disappears, the volume of the liquid storage capsule 210 hardly changes. When the driving external force is applied to the liquid storage body 211, the sealing layer 212 is directionally broken by the edge 222, after that, the driving external force is removed, and the liquid in the liquid storage capsule 210 is not being pressed by the external force during release.

The support platform 240 is configured to form the guiding chamber 221 and realize an effective connection between the liquid storage capsule 210 and the support platform 240. A portion of the support platform 240 corresponds to a sealing region 214 of the liquid storage capsule 210, and the other portion of the support platform 214 corresponds to a portion of the sealing layer 212 enclosed by the sealing region 214. The portion corresponding to the sealing layer 212 occupies a half of the whole sealing layer 212.

Figure 7:
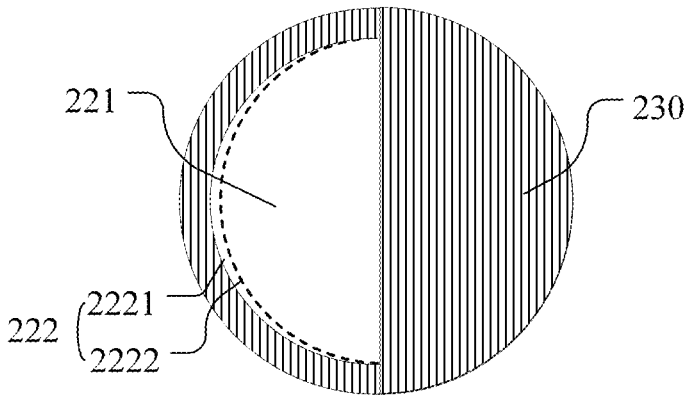
FIG. 7 is a top view of a directional release chamber and a connecting layer of the present disclosure.
Figure 8:
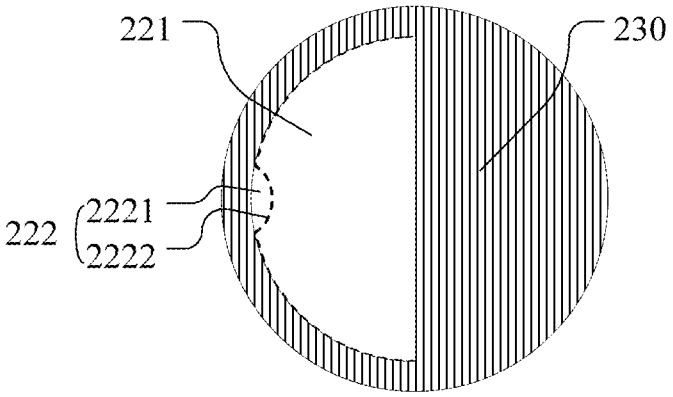
FIG. 8 is another top view of a directional release chamber and a connecting layer of the present disclosure.
Figure 9:
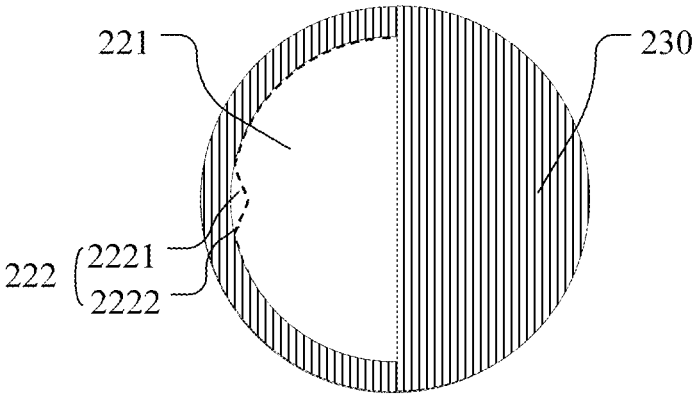
FIG. 9 is another top view of a directional release chamber and a connecting layer of the present disclosure.

The substrate 100 is driven by the centrifugal force to rotate during operation. The substrate 100 has a rotation center during rotation, so the structure arranged on the substrate 100 will have a proximal end close to the rotation center and a distal end far away from the rotation center. Taking the guiding chamber 221 as an example, the portion of the guiding chamber 221 close to the center of rotation is the proximal end, and the portion of the guiding chamber 221 far away from the center of rotation is the distal end. The edge 222 is arranged at the distal end of the guiding chamber 221. Specifically, the edge 222 is a relatively sharp structure formed by extending a side wall of the guiding chamber 221 on the top. Specifically, the edge 222 includes a first edge surface 2221 extending from the end face of the support platform 240 towards a center of the guiding chamber 221 and a second edge surface 2222 extending from the first edge surface 2221 towards the bottom of the guiding chamber 221. A junction between the first edge surface 2221 and the second edge surface 2222 is configured to break the sealing layer 212, and the breaking point matches the second edge surface 2222, wherein the second edge surface 2222 is an arc structure protruding towards the outside of the guiding chamber 221, as shown in FIG. 7. Or the second edge surface 2222 is a semicircular structure or a triangular structure protruding towards the inside of the guiding chamber 221, as shown in FIGS. 8 and 9. In order to ensure the complete break of the edge 222, the second edge surface 2222 is perpendicular to the bottom of the guiding chamber 221, or the second edge surface 2222 is tilted, and the distance between the second edge surface 2222 and the center of the guiding chamber 221 gradually increases along a direction from an opening of the guiding chamber 221 to the bottom of the guiding chamber 221.

When external force is applied to press the liquid storage body 211, the liquid 213 in the liquid storage capsule 210 is forced to expand the sealing layer 212, so that the sealing layer 212 is gradually pushed to the sharp edge 222 for inducing break. After the edge 222 contacts with the sealing layer 212, a breaking point is generated on the sealing layer 212 according to the shape of the edge 222, and the liquid storage capsule 210 is in communication with the guiding chamber 221. The liquid sealed in the liquid storage capsule 210 will flow out of the opening located on the distal end. All the liquid in the liquid storage capsule 210, driven by the centrifugal force, can be transferred through the opening without a dead angle, so as to realize the complete release of the liquid.

The liquid storage body 211 is made from a hemispherical or semi ellipsoidal thermoforming plastic film or cold stamping forming pharmaceutical packaging composite film. The thermoforming plastic film is a thermoforming polyvinyl chloride (PVC) film, a thermoforming polypropylene (PP) film, a thermoforming polyethylene (PE) film or a thermoforming polyethylene terephthalate (PET) film. And the cold stamping forming pharmaceutical packaging composite film is OPA (1, 2-phthalic dicarboxaldehyde)/aluminum (AL)/polyvinyl chloride (PVC) composite film and OPA (1, 2-phthalic dicarboxaldehyde)/aluminum (AL)/polypropylene (PP) composite film. In order to allow the liquid storage body 211 to keep good deformability, the thermoforming plastic film or the cold stamping forming pharmaceutical packaging composite film has a thickness between 50 μm and 150 μm. Further, in order to ensure that the liquid storage body 211 has good sealing performance and light-proof performance, a first aluminum foil layer is provided inside the cold stamping forming pharmaceutical packaging composite film. Since the liquid storage capsule 210 has very little non-reversible deformation in the release process of the liquid 213 in the embodiment of the present disclosure, air pressure balance in the closed system will not be affected basically.

The sealing layer 212 is sealed on the liquid storage capsule 210 by ultrasonic welding, hot pressing or gluing. The liquid 213 is quantitatively sealed in the liquid storage capsule 210 by adopting the above process. The present disclosure is not limited to the above sealing methods only, all methods for sealing the sealing layer 212 on the liquid storage body 211 are within the protection scope of the present disclosure.

The sealing layer 212 has a shape matching with the projection of the liquid storage body 211 on the sealing layer 212. The embodiment of the present disclosure is not limited to the matching structure, the size of the sealing layer 212 can also be greater than the projection of the liquid storage body 211 on the sealing layer 212, and the size of the sealing layer 212 can also be slightly less than the projection of the liquid storage body 211 on the sealing layer 212.

The sealing layer 212 is made of brittle material which can be broken under a force. Sealing strength of the sealing region 214 between the sealing layer 212 and the liquid storage body 211 is greater than the strength required to cause the sealing layer 212 broken under a force. Such that, only the sealing layer 212 is broken when the sealing layer 212 is under a force, and the sealing region 214 will not be broken, thereby ensuring that the liquid 213 will flow through the broken area of the sealing layer 212 only. In an embodiment, the sealing layer 212 includes a second aluminum foil layer, and the second aluminum foil layer has a thickness between 10 μm and 100 μm.

The second aluminum foil layer is made from a brittle material, and adhesive auxiliary material can be coated on the surface of the second aluminum foil layer. Therefore, the sealing layer 212 may further include a hot-melt adhesive layer coated on the second aluminum foil layer.

In order to reach better release effect, the volume of the liquid stored in the liquid storage capsule 210 is 40% to 100% of the discharge volume when the liquid storage body 211 is completely concave. In an embodiment, the volume of the liquid stored in the liquid storage capsule 210 is 60% to 90% of the discharge volume when the liquid storage body 211 is completely concave.

In an embodiment of the present disclosure, the guiding chamber 221 functions to collect the liquid 213 flowing from the liquid storage capsule 210 and guide the liquid 213 to the downstream micro channel 101. Generally, the guiding chamber 221 is provided on the substrate 100 for the liquid storage capsule 210 to be loaded. The substrate 100 is configured to process a biological detection chip. Specifically, the guiding chamber 221 is a guiding groove recessing downward provided in the substrate 100, a portion surrounding the guiding groove is the support platform 240, the guiding groove is in communication with a downstream micro channel 101, and the whole support platform 240 is tightly covered by the sealing layer, so as to ensure that an internal channel of the whole liquid storage and controlled-release device 200 is isolated from the outside.

The substrate 100 may be made from glass, silicon, metal, polymer, or a mixture thereof. The polymer may be one or more of polydimethylsiloxa (PDMS), polymethyl methacrylate (PMMA), PC engineering plastic, copolymers of cycloolefin (COC), polyethylene terephthalate (PET), COP of Japan and acrylonitrile butadiene styrene copolymers (ABS).

The volume of the guiding groove is greater than, less than or equal to the volume of the liquid storage capsule 210, so that the guiding groove can store part or all of the liquid 213 in the liquid storage capsule 210. In an embodiment, the volume of the guiding groove is equal to the volume of the liquid storage capsule 210.

The edge 222 functions to break the sealing layer 212. The edge 222 is directly arranged on a wall of the guiding groove or an opening of the guiding groove. The edge 222 is integrally formed with the guiding groove or the edge 222 is fixed together with the guiding groove by bonding or other processes. In an embodiment, the edge 222 is integrally formed with the guiding groove in the present disclosure. The edge 222 extends from the wall of the guiding groove towards the cavity of the guiding groove, and the distal end of the edge 222 corresponds to a region enclosed by the sealing region 214 of the sealing layer 212. The shape and the size of the edge 222 may be any type that is easy to be placed and integrally formed, as long as it is ensured that the pressure is transmitted downward to the sealing layer 212 and the sealing region 214 via the top of a liquid 213 accommodating chamber to cause the sealing layer 212 to expand downward, and the reaction force of the edge 222 on the sealing layer 212 allows the sealing layer 212 to be broken and other positions do not leak and break when the sealing layer 212 contacts with the edge 222. The distance between the highest point of the edge 222 and the sealing layer 212 is not greater than the distance between the upper surface of the substrate 100 and the sealing layer 212, thereby ensuring that the edge 222 is not in contact with the sealing layer 212 when the liquid storage capsule 210 is not under force.

Figure 3:
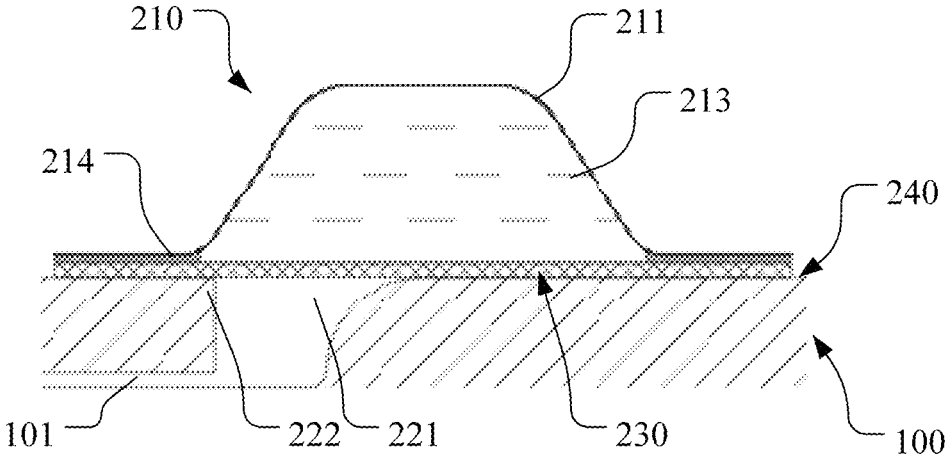
FIG. 3 is another sectional view of a liquid storage and controlled-release device of the present disclosure.
Figure 4:
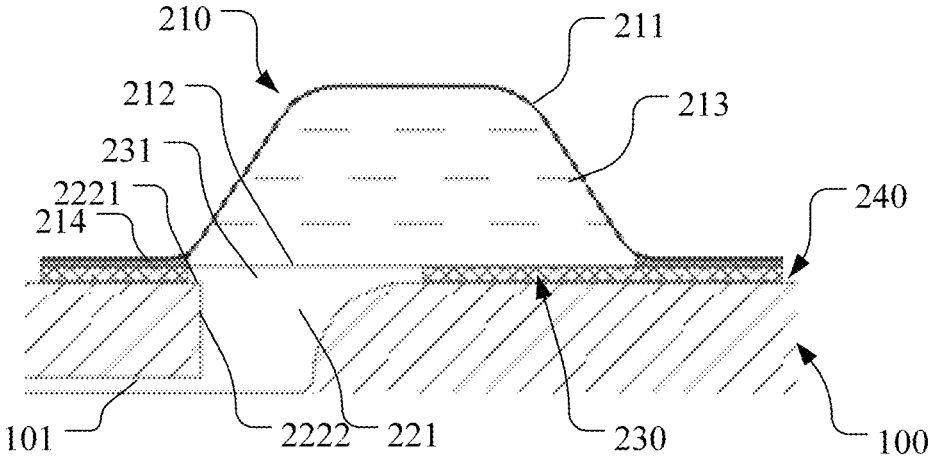
FIG. 4 is another schematic sectional view of a liquid storage and controlled-release device of the present disclosure.

In order to ensure that there is only one edge 222 on the guiding groove, the groove wall corresponding to the proximal end of the guiding groove is in a rounded angle structure protruding towards the center of the guiding groove, as shown in FIGS. 3 and 4.

The liquid storage capsule 210 is tightly connected with the support platform 240 by a connecting layer 230, which may be done by welding or clamping device, all modes for implementing the tight connection are within the protection scope of the present disclosure. For example, when the liquid storage capsule 210 is connected with the support platform 240 through the connecting layer 230, a side of the connecting layer 230 is fixedly bonded with the substrate 100, and the another side of the connecting layer 230 is fixedly bonded with the sealing layer 212. The connecting layer 230 is a double-faced adhesive tape, an ultraviolet curing adhesive or an epoxy adhesive. Other methods for implementing the double-faced fixation are within the protection scope of the present disclosure.

In an embodiment of the present disclosure, the shape of the connecting layer 230 is the same as that of the sealing layer 212. In addition to function to connect the liquid storage capsule 210 with the directional release chamber 220, the connecting layer 230 further functions to buffer and protect the sealing layer 212. When the connecting layer 230 completely covers the sealing layer 212, the liquid storage capsule 210 is connected to the direction release chamber 220 through the connecting layer 230. When the liquid storage capsule 210 is pressed, the edge 222 successively breaks the connecting layer 230 and the sealing layer 212, thereby the liquid is directionally released, as shown in FIG. 3.

Figure 5:
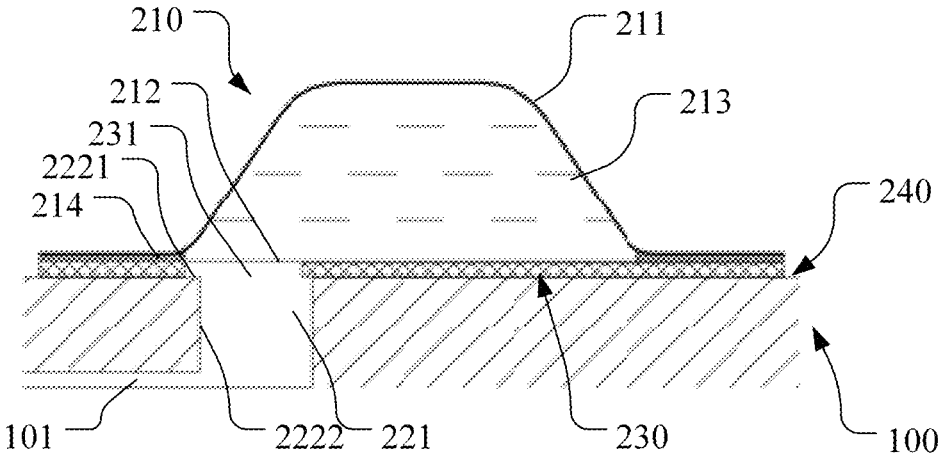
FIG. 5 is another schematic sectional view of a liquid storage and controlled-release device of the present disclosure.
Figure 6:
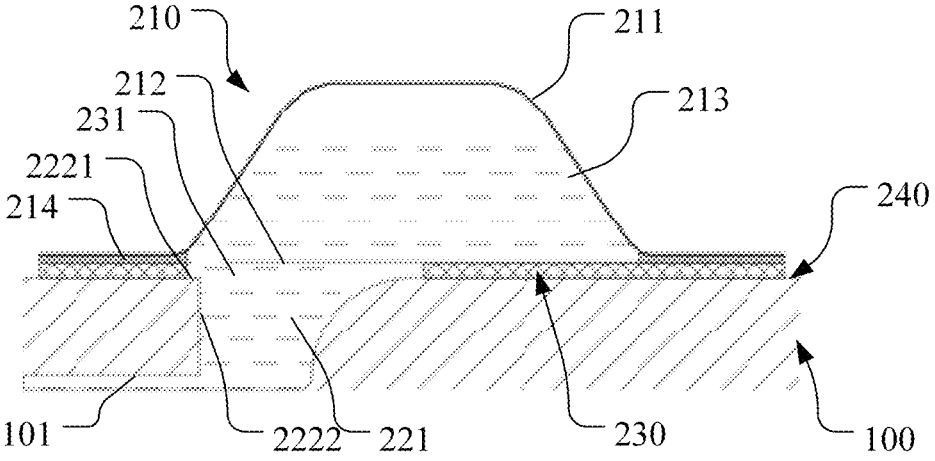
FIG. 6 is a schematic view showing the flow of liquid in the liquid storage device when a sealing layer is broken by the edge for inducing break of the present disclosure.

In an embodiment of the present disclosure, a blank region without material 231 is provided at a position of the connecting layer 230 corresponding to the guiding groove. That is, a through hole is provided at the position of the connecting layer 230 corresponding to the guiding groove. The blank region without material 231 is circular, semicircular or elliptic, as shown in FIGS. 4 and 5. The liquid storage capsule 210 is connected to the directional release chamber 220 through the connecting layer 230. The connecting layer 230 is provided with a blank region without material 231. The connecting layer 230 protects the region outside the edge for inducing break. When the liquid storage capsule 210 is pressed, the edge 222 directly contacts with the sealing layer 212, and the sealing layer 212 is broken, while the other regions are not broken due to the buffer function of the connecting layer 230, thereby directionally releasing the liquid.

The shape of the connecting layer 230 is the same as that of the sealing layer 212. The area of the connecting layer 230 is less than, equal to or greater than that of the sealing layer 212. When the connecting layer 230 and the sealing layer 212 completely coincide, that is, under the premise of the same shape, the area of the connecting layer and the sealing layer is the same. The radial outermost end of the blank region without material 231 in the connecting layer 230 is tangent or partially overlapped with the sealing region 214 of the sealing layer 212.

In the embodiment of the present disclosure, an external force is applied to the liquid storage capsule 210, and the external force acts on the sealing layer 212 via the blank region without material 231 or directly breaks through the connecting layer 230, so that the sealing layer 212 of the liquid storage capsule 210 contacts with the edge 222 and is broken. The released liquid 213 flows out of the breaking point between the sealing layer 212 and the edge 222 based on gravity and driving force, and goes into the guiding chamber 221. All the liquid flows into the downstream closed or open chamber via the micro channel 101, no liquid residue is left after release.

The external force cooperates with a flat head press to achieve the liquid release from the liquid storage body 211 of the liquid storage and controlled-release device. The flat head press is driven manually or by an instrument. The external force causes the sealing layer 212 to contact with the edge 222 and broken, and then the external force is removed, there is no need to continuously apply. The external force causes the liquid storage capsule 210 to undergo reversible deformation or slightly non-reversible deformation, that is, after the external force disappears, the volume of the liquid storage capsule hardly changes. In order to reach best effect of applying the external force, the area of the flat head press is greater than or equal to the top projection area of the liquid storage body 211.

Driving forces are commonly used for in vitro diagnostic products, which include centrifugation, chromatography, capillary, hydrophilic modification and other modes. When the driving force is the centrifugal force, the advantage is that after the external force is acted on the liquid storage capsule 210, the sealing layer 212 is broken by the edge 222. Cooperating with the centrifugal rotation, the liquid 213 in the liquid storage capsule 210 can be completely released without residue. When the liquid 213 flows through the downstream micro channel 101 with high fluid resistance, especially when the downstream micro channel 101 is in a close environment, the gas originally existing in the guiding chamber 221 and the micro channel 101 is pushed by the liquid 213, and then get into the liquid storage capsule 210 reversely after gas-liquid exchange. Since the added accommodating space of the whole chip system is always greater than or equal to the volume of the liquid flowing into the guiding chamber 221 and the micro channel 101 after the guiding chamber 221 is in communication with the broken and released liquid storage capsule 210, the air pressure in the whole chip system will not increase with the transfer process of the liquid 213.

Furthermore, when the product needs to be heated (commonly used in the detection of pathogenic microorganisms and the nucleic acids thereof), the increase of temperature will lead to the increase of air pressure in the sealed pipeline. Due to the deformability and toughness of the material of the liquid storage capsule 210, it can offset the increased air pressure to a certain extent, thus increasing the service stability of the whole disk or chip system.

Figure 10:
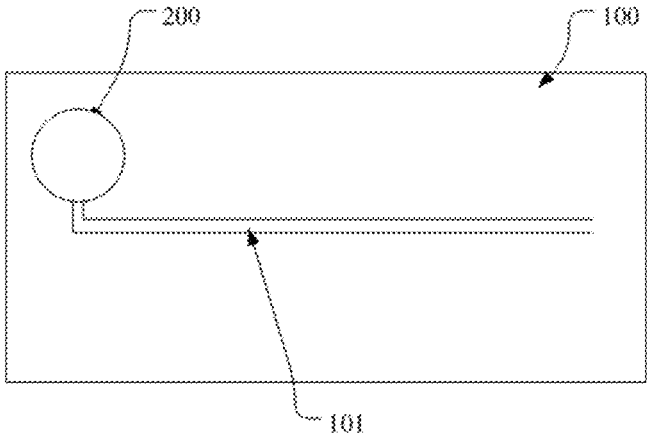
FIG. 10 is a schematic view showing the arrangement of liquid storage and controlled-release device in a biological detection chip of the present disclosure.
Figure 11:
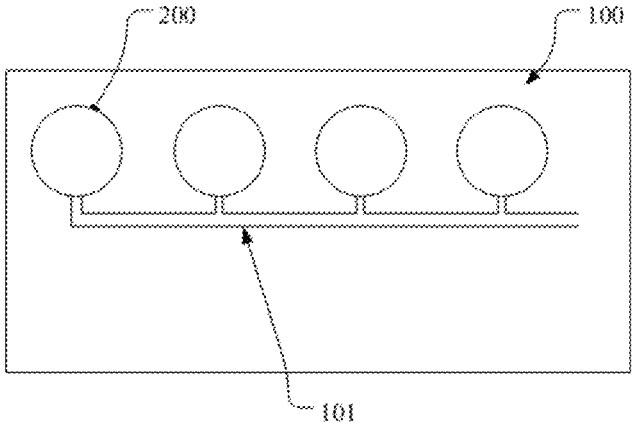
FIG. 11 is another schematic view showing the arrangement of liquid storage and controlled-release device in a biological detection chip of the present disclosure.
Figure 12:
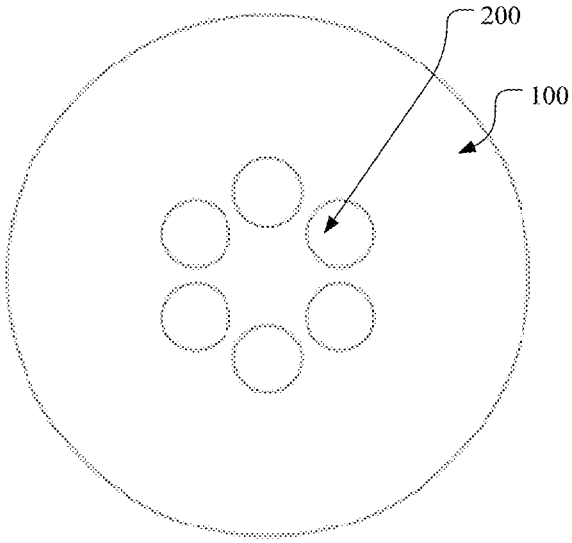
FIG. 12 is another schematic view showing the arrangement of liquid storage and controlled-release device in a biological detection chip of the present disclosure.

Referring to FIGS. 10 to 12, a biological detection chip is further disclosed in the present disclosure, which includes the substrate 100 and the liquid storage and controlled-release device 200 as described in any one of the above embodiments. Since the liquid storage and controlled-release device 200 has the above-mentioned advantages, the biological detection chip including the liquid storage and controlled-release device 200 also has the corresponding technical effects, which would not be described here again.

Referring to FIG. 10, one liquid storage and controlled-release device 200 may correspond to one micro channel on the substrate 100. Referring to FIG. 11, multiple liquid storage controlled-release devices 200 may correspond to one or more micro channels on the substrate 100. By providing one or more liquid storage and controlled-release devices 200 on the substrate 100, different types of liquid are released or different types of liquid are released in order, or the same liquid is released in order. The number of liquid storage and controlled-release devices 200 is not limited to the same as shown in the figures, it can be two, three, five, six and the like. And the number of liquid storage and controlled-release devices 200 is determined by the specific biological detection processes.

When the substrate 100 contains multiple liquid storage and controlled-release devices 200, the liquid storage and controlled-release devices 200 may be arranged in a straight line, as shown in FIG. 11, or the liquid storage and controlled-release devices 200 may be arranged on a circle, as shown in FIG. 12. Certainly, the arrangement type of the liquid storage and controlled-release devices 200 in the present disclosure is not limited to the above two arrangements, and may also be other arrangements, such as curve, arc, or scattered layout, which are determined by the design of the specific liquid circuit. By arranging in different structural mode, the liquid storage and controlled-release devices 200 can release the liquid according to a specific order.

The following will be described in conjunction with the common process of molecular biology test, as shown in FIG. 11. Four liquid storage and controlled-release devices 200 respectively contain four kinds of reagents from left to right, including lysis buffer, wash buffer, wash buffer and elution buffer. In a specific detection, a sample to be detected is first added to the biological detection chip, and the liquid storage capsule 210 storing the lysis buffer is first pressed, and the lysis buffer is released to the downstream micro channel 101 to mix with the sample to be detected to complete the lysis reaction. Then, the liquid storage capsule 210 storing wash buffer is pressed, and the wash buffer is released to the downstream micro channel 101 to clean the nucleic acid captured after the lysis reaction for the first time; the next liquid storage capsule 210 storing the wash buffer is pressed, and the wash buffer is released to the downstream micro channel 101 to clean the nucleic acid for the second time. Finally, the liquid storage capsule 210 storing the elution buffer is pressed, and the elution buffer is released to the downstream micro channel 101 to elute the captured nuclear acid, and then the eluted nucleic acid flows to the downstream micro channel 101, and the subsequent amplification is performed and completed.

The biological detection chip of the present disclosure is described in detail hereinbefore. The principle and the embodiments of the present disclosure are illustrated herein by specific examples. The above description of examples is only intended to help the understanding of the method and spirit of the present disclosure. It should be noted that, for those skilled in the art, many modifications and improvements may be made to the present disclosure without departing from the principle of the present disclosure, and these modifications and improvements are also deemed to fall into the protection scope of the present disclosure defined by the claims.

What is claimed is:

1. A liquid storage and controlled-release device, capable of being provided on a substrate, wherein the substrate is configured to be driven to rotate by a centrifugal force, and wherein the liquid storage and controlled-release device comprises:

a liquid storage capsule, wherein, the liquid storage capsule is provided with a liquid storage body which is deformable under a pressure and a sealing layer for sealing the liquid storage body, and a space formed by the sealing layer and the liquid storage body is configured for liquid storage, a sealing region is provided between the sealing layer and the liquid storage body, and seal strength of the sealing region is greater than strength required to break the sealing layer under a force;

an edge comprising a first edge surface extending from an end face of the support platform to a center of a guiding chamber and a second edge surface extending from the first edge surface to the bottom of the guiding chamber, wherein a junction between the first edge surface and the second edge surface is configured to be able to break the sealing layer, and wherein a breaking point matches the second edge surface; and a support platform provided right below the liquid storage capsule and connected with the liquid storage capsule, wherein, a directional release chamber is provided in the middle of the support platform, and the directional release chamber is provided with a guiding chamber for collecting the liquid and a sharp edge for inducing break, the edge is formed by a side wall at distal end of the guiding chamber on the top, and the depth of the guiding chamber is greater than the maximum downward deformation depth of the sealing layer before broken when the liquid storage body is subjected to a pressure;

wherein the guiding chamber is a guiding groove recessing downward provided in the substrate, a portion surrounding the guiding groove is the support platform, the guiding groove is in communication with a downstream micro channel, the whole support platform is covered by the sealing layer and a wall of the proximal end of the guiding groove is in a rounded angle structure protruding towards the center of the guiding groove; and wherein, when an external force is applied to the liquid storage body, the sealing layer is forced to deform towards the inside of the guiding chamber, and a breaking point on the sealing layer is generated by the edge according to the shape of the edge, so that the liquid storage capsule is in communication with the guiding chamber.

2. The liquid storage and controlled-release device according to claim 1, wherein the second edge surface is an arc structure protruding towards the outside of the guiding chamber, or a semicircular structure or a triangular structure protruding towards the inside of the guiding chamber.

3. The liquid storage and controlled-release device according to claim 1, wherein the liquid storage body is a hemispherical or semi ellipsoidal thermoforming plastic film or cold stamping forming pharmaceutical packaging composite film.

4. The liquid storage and controlled-release device according to claim 3, wherein a first aluminum foil layer is provided inside the cold stamping forming pharmaceutical packaging composite film.

5. The liquid storage and controlled-release device according to claim 1, wherein the sealing layer has a shape matching with the projection of the liquid storage body on the sealing layer.

6. The liquid storage and controlled-release device according to claim 1, wherein the sealing layer comprises a second aluminum foil layer.

7. The liquid storage and controlled-release device according to claim 1, wherein the volume of the liquid stored in the liquid storage capsule is 40% to 100% of the discharge volume when the liquid storage body is completely concave.

8. The liquid storage and controlled-release device according to claim 1, wherein the edge extends from the wall of the guiding groove towards the cavity of the guiding groove, and the distal end of the edge corresponds to a region enclosed by the sealing region of the sealing layer.

9. The liquid storage and controlled-release device according to claim 1, wherein the distance between the highest point of the edge and the sealing layer is not greater than the distance between the upper surface of the substrate and the sealing layer.

10. The liquid storage and controlled-release device according to claim 1, wherein the liquid storage capsule is connected with the support platform by a connecting layer, welding or a clamping device.

11. The liquid storage and controlled-release device according to claim 10, wherein, when the liquid storage capsule is connected with the support platform through the connecting layer, a side of the connecting layer is fixedly bonded with the support platform, and the another side of the connecting layer is fixedly bonded with the sealing layer.

12. The liquid storage and controlled-release device according to claim 11, wherein, the shape of the connecting layer is the same as that of the sealing layer.

13. The liquid storage and controlled-release device according to claim 11, wherein, a blank region without material is provided at a position of the connecting layer corresponding to the guiding groove.

14. The liquid storage and controlled-release device according to claim 13, wherein, when the connecting layer and the sealing layer completely coincide, the radial outermost end of the blank region without material in the connecting layer is tangent or overlapped with the sealing region of the sealing layer.

15. The liquid storage and controlled-release device according to claim 1, wherein the liquid storage body cooperates with a flat head press to realize the release.

16. The liquid storage and controlled-release device according to claim 15, wherein the area of the flat head press is greater than or equal to the top projection area of the liquid storage body.

17. A biological detection chip, comprising a substrate and a liquid storage and controlled-release device according to claim 1 provided on the substrate.

18. The biological detection chip according to claim 17, wherein one or more liquid storage and controlled-release devices may be arranged on the substrate, and are respectively communicated with micro channels at a downstream location.

19. The biological detection chip according to claim 18, wherein, when the substrate is provided with a plurality of the liquid storage and controlled-release devices, the liquid storage and controlled-release devices are arranged on a straight line, or the liquid storage and controlled-release devices are arranged on a circle, or are arranged according to demand.

* * * * *